US008739469B1

(12) United States Patent
Fortun et al.

(10) Patent No.: US 8,739,469 B1
(45) Date of Patent: Jun. 3, 2014

(54) PROTECTIVE COVER

(71) Applicant: Endura Products, Inc., Colfax, NC (US)

(72) Inventors: Mark Fortun, Summerfield, NC (US); Brent Van Camp, Kernersville, NC (US)

(73) Assignee: Endura Products, Inc., Colfax, NC (US)

( * ) Notice: Subject to any disclaimer, the term of this patent is extended or adjusted under 35 U.S.C. 154(b) by 0 days.

(21) Appl. No.: 13/852,525

(22) Filed: Mar. 28, 2013

(51) Int. Cl.
*E05B 1/00* (2006.01)

(52) U.S. Cl.
USPC ..... 49/460; 49/467

(58) Field of Classification Search
USPC ..... 49/460, 462, 467, 471; 52/179, 211, 52/213, 309, 201.1, 3, DIG. 12, 716.1, 52/716.2, 717.01, 718.01, 730.3, 741.3, 52/181, 105, 515
See application file for complete search history.

(56) References Cited

U.S. PATENT DOCUMENTS

| | | | | |
|---|---|---|---|---|
| 2,290,472 | A | 7/1942 | Hendrick | |
| 2,332,579 | A | 10/1943 | Kirby | |
| 4,079,550 | A | 3/1978 | Bursk et al. | |
| 4,193,375 | A | 3/1980 | Sharland et al. | |
| 4,310,991 | A * | 1/1982 | Seely | 49/470 |
| 4,357,898 | A | 11/1982 | Fehrenbacher | |
| 5,018,307 | A | 5/1991 | Burrous et al. | |
| 5,426,894 | A | 6/1995 | Headrick | |
| 5,588,266 | A | 12/1996 | Headrick | |
| 5,611,173 | A | 3/1997 | Headrick et al. | |
| 6,044,600 | A | 4/2000 | McCollough | |
| 6,052,949 | A | 4/2000 | Procton et al. | |
| 6,138,413 | A | 10/2000 | Fehr | |
| 6,216,395 | B1 * | 4/2001 | Kelly | 49/467 |
| 6,269,591 | B1 * | 8/2001 | Kelly | 49/482.1 |
| D474,844 | S | 5/2003 | Babka et al. | |
| 6,789,358 | B2 * | 9/2004 | Procton et al. | 49/471 |
| 6,829,864 | B2 * | 12/2004 | Mitchell et al. | 52/211 |

(Continued)

FOREIGN PATENT DOCUMENTS

| | | | |
|---|---|---|---|
| GB | 2161726 | A | 1/1986 |
| GB | 2373812 | A | 10/2002 |
| GB | 2418448 | A | 3/2006 |

OTHER PUBLICATIONS

Web page entitled "Job Site Sill Covers," http://www.enduraproducts.com/product-overview/components/sill-components/job%20site%20covers.aspx. Known as of Mar. 27, 2013. 1 page.

(Continued)

*Primary Examiner* — Jerry Redman
(74) *Attorney, Agent, or Firm* — Womble Carlyle Sandridge & Rice, LLP

(57) ABSTRACT

A cover for protection of a threshold. The cover includes a first flange. Extending from the first flange is a first portion intended to protect a sill channel or a threshold cap of the threshold. Extending from the first portion is a second portion intended to protect a sill deck of the threshold. Extending from the second portion is a second flange. The second flange has openings in the form of apertures or notches configured to allow water to drain from under the cover.

20 Claims, 4 Drawing Sheets

(56) References Cited

U.S. PATENT DOCUMENTS

| | | | | |
|---|---|---|---|---|
| 7,600,346 | B2 * | 10/2009 | Meeks | 49/471 |
| 8,522,483 | B2 * | 9/2013 | Van Camp et al. | 49/469 |
| 8,567,128 | B2 * | 10/2013 | Van Camp et al. | 49/468 |
| 2005/0144865 | A1 * | 7/2005 | Ellingson | 52/272 |
| 2005/0210754 | A1 | 9/2005 | Ferrell | |
| 2006/0005470 | A1 * | 1/2006 | Mullen et al. | 49/467 |
| 2006/0225364 | A1 * | 10/2006 | Chen | 49/467 |
| 2010/0300001 | A1 | 12/2010 | Wernlund et al. | |
| 2013/0091776 | A1 * | 4/2013 | Van Camp et al. | 49/467 |

OTHER PUBLICATIONS

Web page entitled "High Dam Sills," http://www.codelentrysystems.com/features/sills.aspx?tabIndex=3. Known as of Mar. 27, 2013. 1 page.

Web page entitled "New Sill Protector by Pollard Windows Inc.," http://www.pollardwindows.com/press_releases/pr_sill_protector.htm. Known as of Mar. 27, 2013. 1 page.

Web page entitled "Sure Sill," http://www.enduraproducts.com/product-overview/components/sill-components/suresill.aspx. Known as of Mar. 27, 2013, 1 page.

* cited by examiner

PROTECTIVE COVER

FIELD OF INVENTION

This disclosure relates to thresholds used in commercial and residential building entryways. Particularly, this disclosure relates to protective covers for use with thresholds during building construction or renovation.

BACKGROUND

Entryways in commercial and residential buildings serve several important purposes in their role as a transition from an exterior to an interior environment. The primary goal of an entryway is to allow for ingress and egress while insulating the interior from the exterior. Entryways are intended to prevent intrusion of rainwater. Entryways are also intended to prevent passage of air through the entryway when a door panel is in the closed position, to keeping out cold air in the winter and keeping in air conditioned air in the summer. Entryways can also enhance the appearance of a building using window features, French door arrangements, and varying finishes of sill decks.

Most entryways begin with the same set of base components. Nearly all entryways are framed by a header jamb connected across the top of two vertical side jambs. The bottom of the entryway is then defined by a threshold. These thresholds are typically comprised of a substrate, a sill deck and a threshold cap. The substrate provides a base for the sill deck. The sill deck provides a durable tread surface covering the substrate. The threshold cap fills a channel in, or adjacent to, the substrate to form a sealing surface with the bottom of a door panel.

Sill decks and threshold caps are often installed in the entryway of buildings relatively early in the construction process in order to close the building to the environment. After installation, a significant amount of construction work remains to be performed within the house or building. This continued heavy traffic of workers entering the building, including the movement of substantial equipment and materials, can often lead to denting, scuffing or scratching of the sill deck. Other substances can also stain the threshold during construction, such as dripping paint, stain, or masonry mortar.

Protective covers have been disclosed that are designed to temporarily remain on the threshold during construction. These protective covers help to protect the surface of the sill deck and threshold cap from damage during construction and can be removed by the builder after completion of the final walk through and clean up, to preserve the "like new" appearance of the entryway of the new house.

Besides being susceptible to physical damage, water intrusion between the sill deck and the protective cover can lead to staining of the sill deck. In order to be removable, protective covers are typically manufactured shorter than the threshold so that the protective cover is able to fit between the installed door jambs. As a result, the ends of the sill deck are exposed, allowing water and other debris to find its way between the protective cover and the sill deck. If water becomes trapped between the sill deck and the protective cover, this standing water can cause the surface of the sill deck to oxidize, staining the sill deck and eliminating the intended "like new" appearance. There remains a need for a protective cover that addresses these and other limitations of existing covers.

SUMMARY

The present disclosure includes a cover for protection of a threshold. The cover may include a first flange. The cover may also include a cap protecting portion to be disposed above a sill channel, or a threshold cap, of a threshold, where the cap protecting portion extends from the first flange. A sill deck protecting portion with a substantially constant downward slope may extend from the threshold cap protecting portion. A second flange may extend from the sill deck protecting portion. The second flange may include at least one aperture, or notch, formed through the second flange to allow water to drain from under the cover.

The present disclosure also includes a threshold. The threshold may have a substrate, a sill deck disposed on at least a portion of the substrate, and a cover sized to overlap substantially all of the width of the substrate and sill deck, and overlap the majority of the length of the threshold. The cover can include a first flange, a cap protecting portion disposed above a sill channel, or a threshold cap, of the threshold, extending from the first flange; a sill deck protecting portion having a substantially constant downward slope extending from the threshold cap protecting portion; and a second flange extending from the sill deck protecting portion. The second flange may include at least one aperture, or notch, formed through the second flange, provided to allow water to drain from between the cover and the sill deck.

Additionally, the present disclosure includes a protective cover for a threshold. The protective cover may include a first flange, and a cap protecting portion to be disposed above a sill channel, or threshold cap, of a threshold. Preferably, the cap protecting portion extends linearly from the first flange to a sill deck protecting portion. The sill deck protecting portion preferably includes a substantially constant downward slope extending directly from the cap protecting portion to a second flange. The configuration of the sill deck protecting portion provides a clearance above a sill deck of a threshold. In one embodiment, the second flange extends from the sill deck protecting portion and has a shape configured to at least partially engage an exterior end of a sill deck of a threshold.

These and other aspects of the present invention will become apparent to those skilled in the art after a reading of the following description of the preferred embodiments, when considered in conjunction with the drawings. It should be understood that both the foregoing general description and the following detailed description are exemplary and explanatory only and are not restrictive of the invention as claimed.

DETAILED DESCRIPTION OF THE DRAWINGS

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

As used herein, the term "front" is used to describe portions of the assembly that would be encountered first, or in the near field, by a person viewing the entryway and threshold assembly from the exterior side of the entryway looking inward. The same person viewing the entryway from the exterior side provides a defining reference for the terms "inner" and "outer," where an inner portion resides toward the interior relative to an outer portion.

As used herein, the term "width" is defined as the dimension along the X axis in FIGS. 1-4. The X axis also defines the "lateral" direction. The term "length" refers to the dimension or direction defined by the Y axis in FIGS. 1-4. The term "height" refers to a vertical dimension along the Z axis as defined in FIGS. 1-4.

Figure 1:
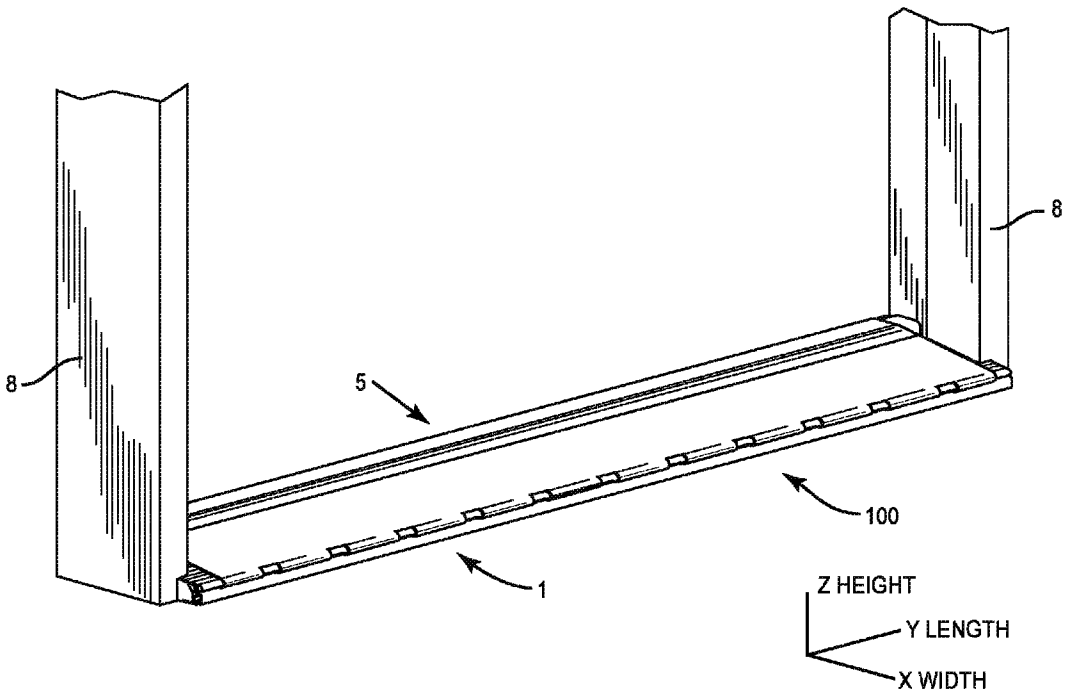
FIG. 1 shows a perspective view of an entryway system having a protective cover according to the present invention.

Turning to the figures, FIG. 1 shows an entryway 100 having a threshold 1 and a pair of jambs 8 installed on each side of the threshold 1. The threshold 1 is shown with a protective cover 5 positioned thereon. The protective cover 5 is sized to protect substantially the entire width of the threshold 1. The protective cover 5 will also overlap at least the majority, and preferably substantially all, of the length of the threshold 1. It should be understood that the protective cover 5 will be slightly shorter in length than the threshold 1 in order to maintain easy removability from between jambs 8. Particularly, the threshold 1 will extend under a portion of jambs 8 of the entryway 100, while the protective cover 5 is intended to be next to or contoured with the jambs 8. The protective cover 5 is preferably formed as a thin plastic extrusion, for example, from a rigid vinyl.

Figure 2:
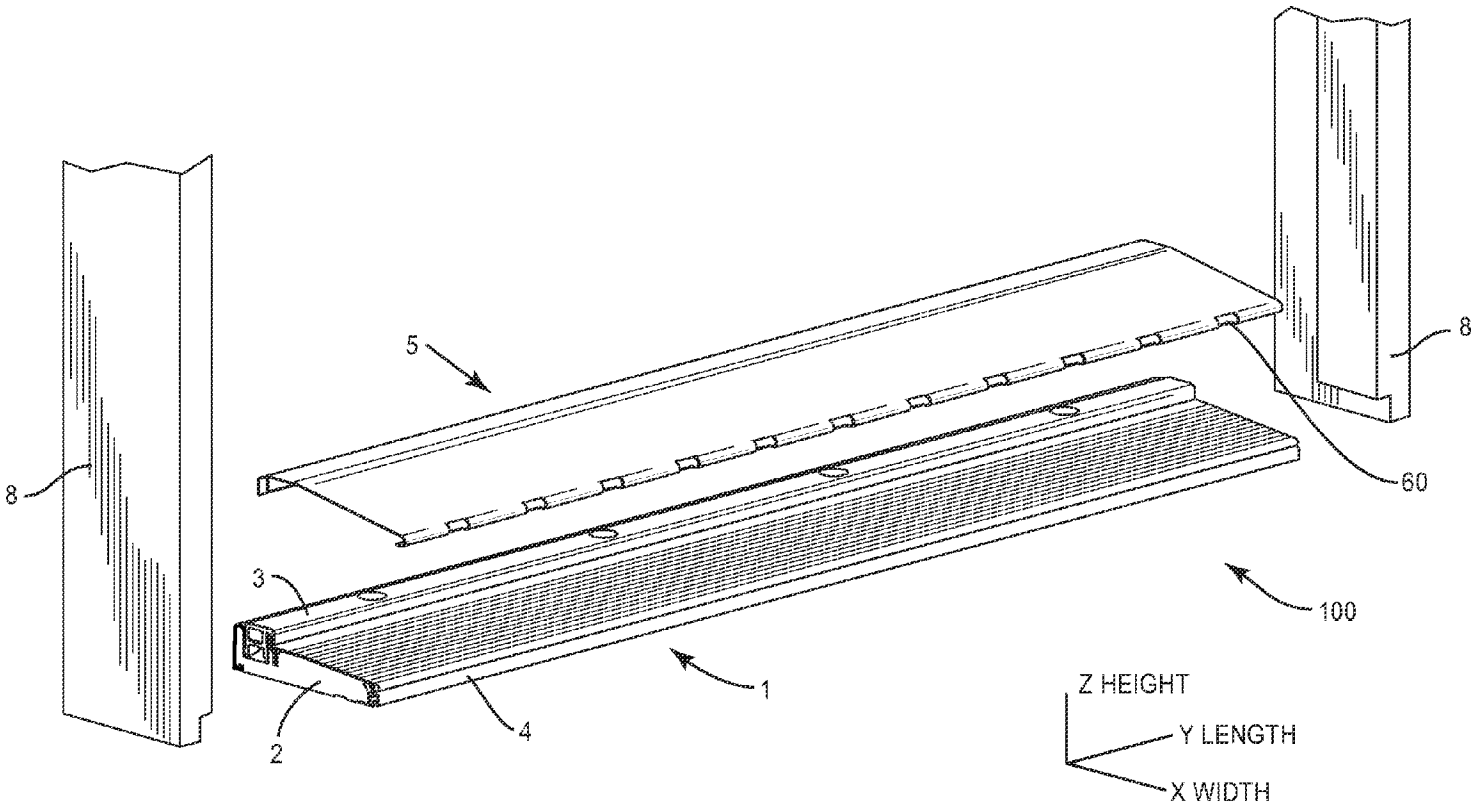
FIG. 2 shows an exploded perspective view of the entryway system of FIG. 1.

FIG. 2 shows an exploded view of the entryway 100. With the protective cover 5 lifted from the threshold 1, it can be seen that the threshold 1 further comprises a substrate 2, a threshold cap 3, and a sill deck 4.

Figure 3:
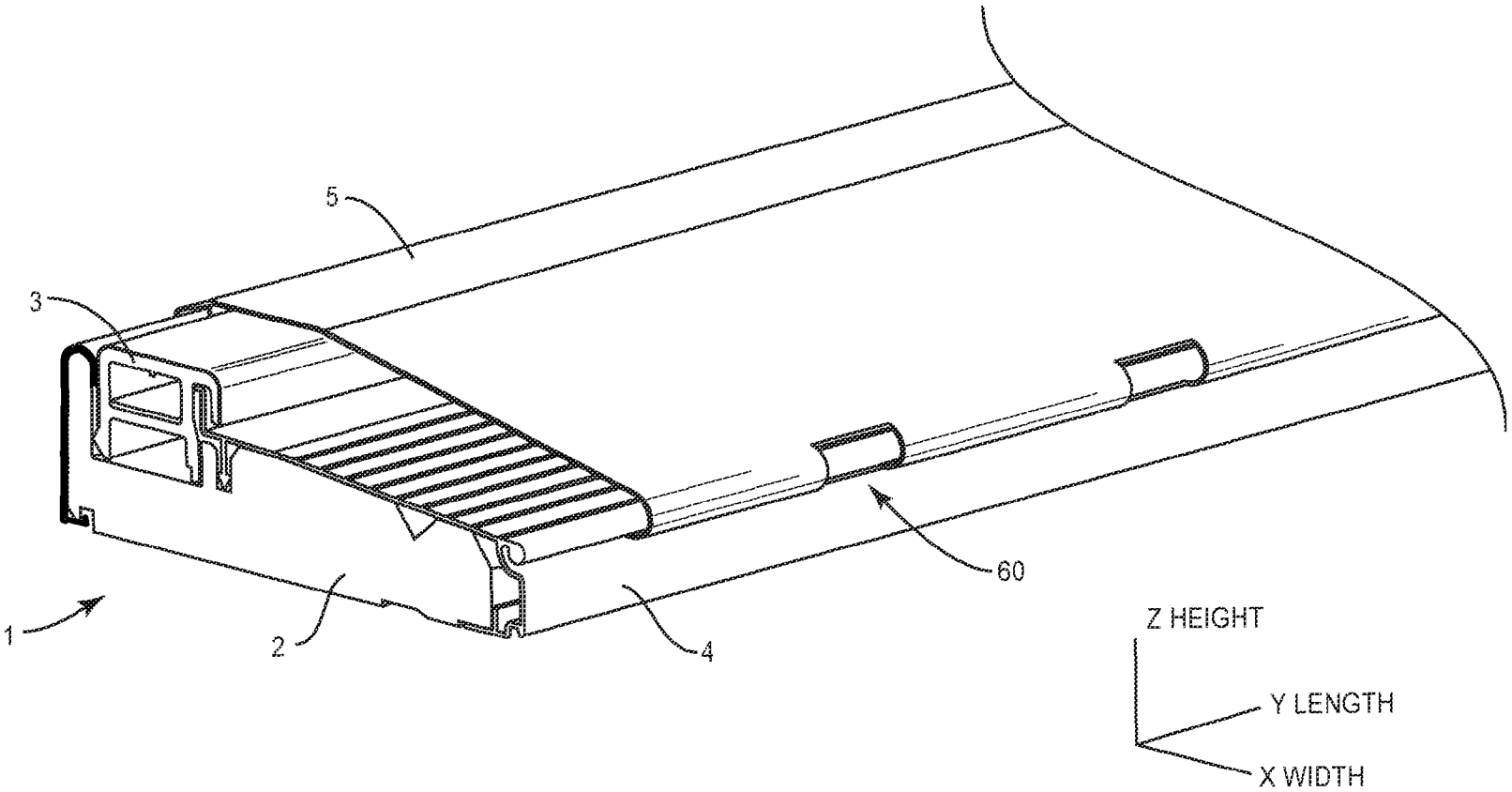
FIG. 3 shows a perspective view of the threshold of FIG. 1 having the protective cover according to the present disclosure.

FIG. 3 shows a perspective view of the threshold 1, with the protective cover 5 installed.

Figure 4:
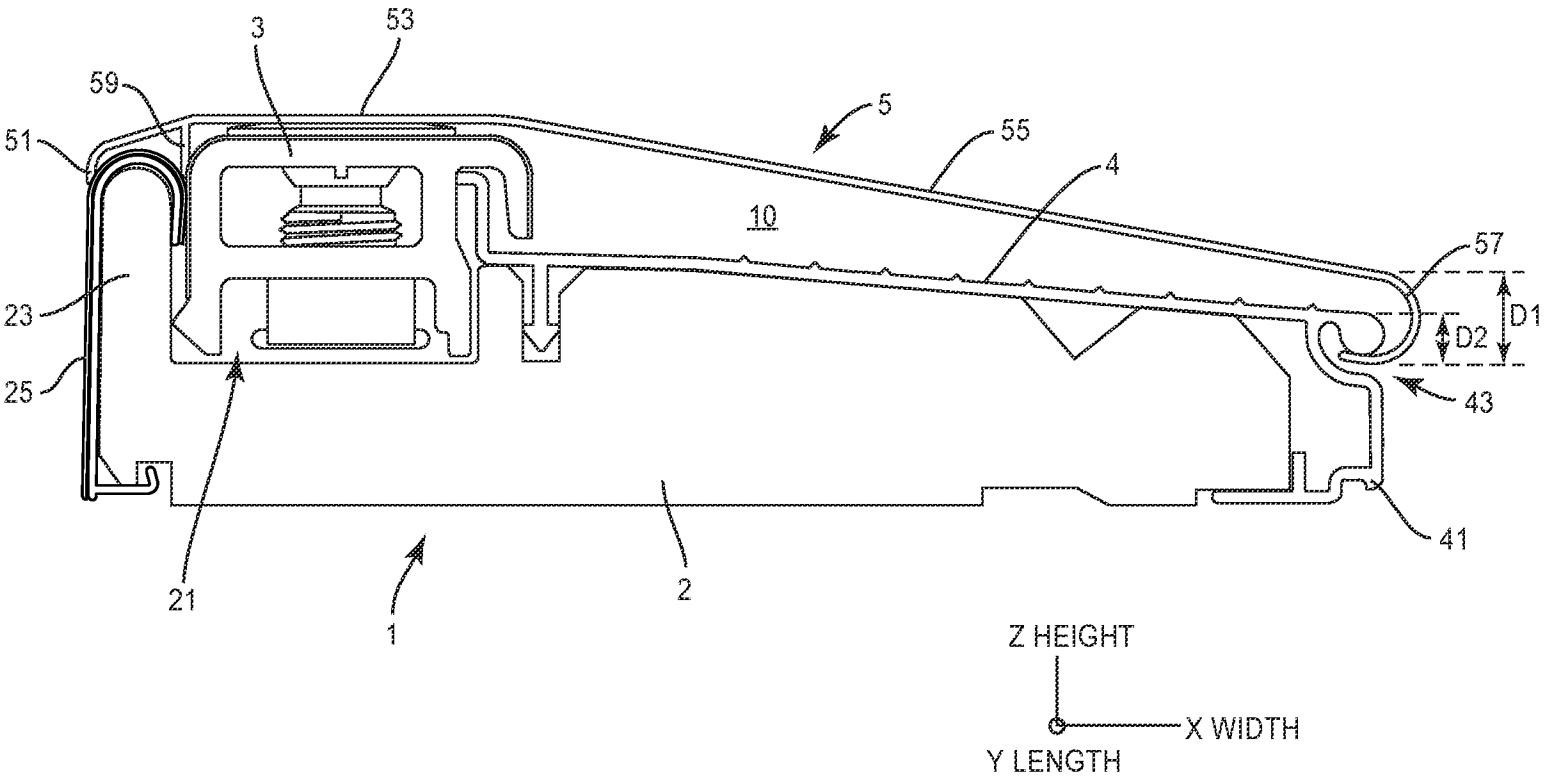
FIG. 4 shows an end view of the threshold of FIG. 3 having the protective cover according to the present disclosure.

As best seen in the end view of the threshold 1 shown in FIG. 4, the substrate 2 may comprise a sill channel 21 and a nosing 23. The nosing 23 may support a nosing cover 25. The sill channel 21 contains the threshold cap 3. In the embodiment shown, the threshold cap 3 is adjustable and can be raised to form a proper seal with the bottom of a door panel (not shown).

The sill deck 4 is disposed on the top of the substrate 2 and forms the tread surface for the threshold 1. The sill deck 4 comprises an exterior end 41 having a slot 43 formed therein. The slot 43 may be generally used to attach deck extensions (not shown) to the sill deck 4.

The protective cover 5 comprises: an interior flange 51 that may be disposed adjacent to the interior of nosing 23 or nosing cover 25; a cap protecting portion 53 extending substantially horizontally from the interior flange 51; a sill deck protecting portion 55 having a substantially constant downward slope, and extending from the cap protecting portion 53; and an exterior flange 57 extending from the sill deck protecting portion 55. The exterior flange 57 can be configured to at least partially engage the slot 43 at the end of the sill deck 4. The exterior flange 57 may be curved, or otherwise project, in a downward and inward direction relative to the sill deck protecting portion 55. The exterior flange 57 may have a radius that sweeps back toward the interior, in order for the exterior flange 57 to engage the slot 43. The engagement between the exterior flange 57 and the exterior end 41 of the sill deck 4 will help to avoid premature or unintended removal of the protective cover 5.

The protective cover 5 may further comprise a tongue 59 extending below the cap protecting portion 53. The tongue 59 is configured to be inserted along the nosing 23 on the side thereof opposite the interior flange 51. In other words, the tongue 59 is configured to be inserted between the nosing 23 and the threshold cap 3 in order to help maintain the positioning of the protective cover 5. The interior flange 51, tongue 59 and exterior flange 57 combine to removably connect the protective cover 5 to the threshold 1.

The sill deck protecting portion 55 covers substantially the full width of the sill deck 4. The sill deck protecting portion 55 is sloped downward, preferably at a constant angle, in order to maintain a clearance 10 between the protective cover 5 and a top surface of the sill deck 4. In other words, the protective cover 5, and particularly the sill deck protecting portion 55, is not contoured to follow the profile of the underlying structure.

The clearance 10 can extend the full width of the sill deck 4, and substantially the full length thereof. By providing the exterior flange 57 with a height D1 greater than the distance D2 between the slot 43 and the top of the sill deck 4, the distal end of the exterior flange 57 will engage the slot 43 and substantially maintain the exterior portion of the sill deck protecting portion 55 above the surface of the sill deck 4.

The clearance 10 left between the protective cover 5 and the sill deck 4 provides a gap in order to avoid water or other debris from becoming trapped between the protective cover 5 and the sill deck 4. It is understood that the protective cover 5 is intended to protect the sill deck 4 from much of the debris in the area, but that due to the shorter length of the protective cover 5, debris, and especially water, are still capable of impinging between the protective cover 5 and the sill deck 4. The clearance 10 will allow the water and debris to flow away from the entryway 100 due to the sloped surface of the sill deck 4. Again, the clearance 10 will help facilitate removal of water that may have been trapped if the protective cover 5 was in close contact with the sill deck 4.

To further facilitate the drainage, or removal of water or debris residing between the sill deck 4 and the protective cover 5, the exterior flange 57 thereof can include at least one aperture 60 formed through the exterior flange 57. Preferably, the at least one aperture 60 will extend to a height above the height of at least a portion of the sill deck 4. This arrangement will increase the capacity of the at least one aperture 60 to drain water. Preferably, a plurality of apertures 60 are formed along the length of the protective cover 5. The apertures 60 form openings through the exterior flange 57. The apertures 60 may alternatively be formed as notches in the exterior flange 57. The apertures 60 are completely surrounded by a portion of the exterior flange 57 while a notch would be cut into the end of the exterior flange 57, thereby having only three sides surrounded by the flange material. The apertures 60, for providing drainage, are preferably between about 0.25 inches and about 1.0 inches in length, and more preferably about 0.75 inches long. The apertures 60 may be spaced apart by a distance of about 1 inch to about 5 inches. Preferably, the apertures 60 are spaced apart by a distance of about 2.5 inches to about 4 inches.

By allowing water to drain out through the apertures 60, the water will not be as likely to remain standing on the sill deck 4, thereby significantly reducing the risk of staining on the sill deck 4 from standing water. Further, the clearance 10 discussed above also provides space for air flow. The air flow will also assist in preventing the occurrence of standing water by helping to move the water around, as well as increasing the potential for evaporation of the water.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A temporary construction cover for removable protection of a threshold having a substrate and a sill deck, comprising:

a) a first flange;

b) a cap protecting portion to be disposed above a sill channel, or a threshold cap, of the threshold, extending generally perpendicularly from the first flange;

c) a sill deck protecting portion having a substantially constant downward slope extending from the threshold cap protecting portion; and d) a second flange extending from the sill deck protecting portion, the second flange having at least one aperture, or notch, formed through the second flange and configured to provide drainage;

wherein, upon completion of construction, the cover is designed to be removed from the threshold to expose the sill deck below.

2. A temporary construction cover according to claim 1, wherein the second flange comprises a shape configured to at least partially engage a slot formed in an exterior end of the sill deck of the threshold.

3. A temporary construction cover according to claim 2, wherein the second flange projects downward and inward relative to the sill deck protecting portion.

4. A temporary construction cover according to claim 2, wherein, when the cover is engaged with the sill deck of the threshold, the at least one aperture, or notch, extends to a first height above a height of at least a portion of the sill deck.

5. A temporary construction cover according to claim 1, further comprising a tongue extending from the bottom of the cover, the tongue configured to be disposed adjacent to a nosing, or a nosing cover, of the threshold, on a side thereof opposite the first flange.

6. A temporary construction cover according to claim 1, wherein the cap protecting portion extends linearly from the first flange to the sill deck protecting portion; and the sill deck protecting portion has a substantially constant downward slope extending directly from the cap protecting portion to the second flange, the sill deck protecting portion configured to form a clearance above the sill deck of the threshold.

7. A temporary construction cover according to claim 1, wherein the first flange, the cap protecting portion, the sill deck protecting portion and the second flange are formed from a single extrusion.

8. An entryway, comprising:

a) a threshold having a substrate and a sill deck disposed on at least a portion of the substrate; and b) a temporary construction cover sized to overlap substantially all of a width of the threshold, and overlap a majority of a length of the threshold, the cover comprising:

a. a first flange;

b. a cap protecting portion disposed above a sill channel, or a threshold cap, of the threshold, extending generally perpendicularly from the first flange;

c. a sill deck protecting portion having a substantially constant downward slope extending from the threshold cap protecting portion; and d. a second flange extending from the sill deck protecting portion, the second flange having at least one aperture, or notch, formed through the second flange and configured to allow water to drain from between the cover and the sill deck;

wherein, upon completion of construction, the cover is designed to be removed from the threshold to expose the sill deck below.

9. An entryway according to claim 8, wherein the cover is configured to provide a clearance above the sill deck along substantially the entire width of the sill deck.

10. An entryway according to claim 8, wherein the sill deck includes a slot at the exterior end thereof for engagement with the second flange such that a clearance is formed between a top surface of the sill deck and the sill deck protecting portion at an exterior end of the sill deck.

11. An entryway according to claim 8, wherein, when the cover is engaged with the sill deck of the threshold, the at least one aperture, or notch, extends to a first height above a height of at least a portion of the sill deck.

12. An entryway according to claim 8, wherein the cap protecting portion extends linearly from the first flange to the sill deck protecting portion; and the sill deck protecting portion has a substantially constant downward slope extending directly from the cap protecting portion to the second flange, the sill deck protecting portion configured to form a clearance above the sill deck of the threshold.

13. An entryway according to claim 8, wherein the cover further comprises a tongue extending from the bottom of the cover, configured to be disposed adjacent to a nosing, or a nosing cover, of the threshold, on a side thereof opposite the second flange.

14. A protective construction cover for temporarily safeguarding a threshold, the cover comprising:

a) a first flange;

b) a cap protecting portion to be disposed above a sill channel, or threshold cap, of the threshold, the cap protecting portion perpendicular to the first flange and extending linearly from an end of the first flange to a sill deck protecting portion;

c) the sill deck protecting portion having a substantially constant downward slope extending directly from the cap protecting portion to a second flange, the sill deck protecting portion configured to form a clearance above a sill deck of the threshold; and d) the second flange extending from the sill deck protecting portion, the second flange having a shape configured to at least partially engage an exterior end of the sill deck of the threshold;

wherein, upon completion of construction, the cover is designed to be removed from the threshold to expose the sill deck below.

15. A protective cover according to claim 14, further comprising at least one aperture, or notch, formed through the second flange and configured to provide drainage.

16. A protective cover according to claim 15, wherein, when the protective cover is engaged with the sill deck, the at least one aperture, or notch, extends to a first height above a height of at least a portion of the sill deck.

17. A protective cover according to claim 15, further comprising a tongue extending from the bottom of the protective cover, configured to be disposed adjacent to a nosing, or a nosing cover, of the threshold, on a side thereof opposite the first flange.

18. A protective cover according to claim 14, wherein the second flange projects downward and inward relative to the sill deck protecting portion.

19. A protective cover according to claim 14, wherein the second flange is configured to engage a slot formed in the exterior end of the sill deck.

20. A protective cover according to claim 14, wherein the first flange, the cap protecting portion, the sill deck protecting portion and the second flange are formed from a single extrusion.

* * * * *